US006042979A

United States Patent [19]

Ohishi et al.

[11] Patent Number: 6,042,979

[45] Date of Patent: Mar. 28, 2000

[54] TONER FOR DEVELOPER OF ELECTROSTATIC LATENT IMAGE, METHOD FOR PRODUCING TONER FOR DEVELOPER OF ELECTROSTATIC LATENT IMAGE, DEVELOPER OF ELECTROSTATIC LATENT IMAGE AND METHOD FOR FORMING IMAGE

[75] Inventors: Kaori Ohishi; Chiaki Suzuki; Masahiro Takagi; Satoshi Inoue; Tetsuya Taguchi; Sueko Sakai, all of Minami-Ashigara, Japan

[73] Assignee: Fuji Xerox Co., Ltd., Tokyo, Japan

[21] Appl. No.: 09/200,453

[22] Filed: Nov. 27, 1998

[30] Foreign Application Priority Data

Dec. 17, 1997 [JP] Japan ..... 9-348341

[51] Int. Cl.[7] ..... G03G 13/01; G03G 9/097

[52] U.S. Cl. ..... 430/45; 430/110; 430/111; 430/126; 430/137

[58] Field of Search ..... 430/45, 110, 111, 430/126, 137

[56] References Cited

U.S. PATENT DOCUMENTS 5,695,902 12/1997 Mikuriya et al. ..... 430/111

FOREIGN PATENT DOCUMENTS 46-5782 12/1971 Japan .
48-47345 7/1973 Japan .
48-47346 7/1973 Japan .
58-216252 12/1983 Japan .
59-34359 2/1984 Japan .
59-34539 2/1984 Japan .
59-198470 11/1984 Japan .
59-231550 12/1984 Japan .
60-123862 7/1985 Japan .
60-136755 7/1985 Japan .
61-279864 12/1986 Japan .
64-42659 2/1989 Japan .
1-185654 7/1989 Japan .
1-281458 11/1989 Japan .
5-72797 3/1993 Japan .
5-94113 4/1993 Japan .
5-188633 7/1993 Japan .
5-204183 8/1993 Japan .
6-51561 2/1994 Japan .
6-102699 4/1994 Japan .
6-95429 4/1994 Japan .
6-208242 7/1994 Japan .
6-238847 8/1994 Japan .
6-250442 9/1994 Japan .
6-266156 9/1994 Japan .
8-115007 5/1996 Japan .

OTHER PUBLICATIONS

Lewis, R.B. et al., "A Charge Spectrograph for Xerographic Toner," Journal of Electrophotographic Society, vol. 22 NO. 1, 1983, pp. 85–87.

Collection of Monographs on Chemical Engineering, vol. 18, No. 3, 1992, pp. 303–307.

*Primary Examiner*—Roland Martin
*Attorney, Agent, or Firm*—Oliff & Berridge, PLC

[57] ABSTRACT

The present invention provides toner for an electrostatic latent image developer, said toner being excellent in fluidity, chargeability, developability, transferability, and freedom from fogging on a photoreceptor and contamination of the interior of a developing device. The toner for an electrostatic latent image developer comprises spherical toner particles characterized by a shape index $ML^2/A$ of less than 125 and has a correlation coefficient between $X^{2/3}$ and Y, obtained by linear regression with respect to a straight line which passes through the origin of coordinate axes, of more than 0.6 where X is the light emitting voltage due to the carbon derived from the binder resin of the toner particles and Y is the light emitting voltage due to the element derived from the external additive.

15 Claims, 4 Drawing Sheets

| y=m0 * m1 | | |
|---|---|---|
| | VALUE; | ERROR; |
| m1 | 0.93758 | 0.0069093 |
| CHI-SQUARE | 186.78 | NA |
| R | 0.70203 | NA |

| y=m0 * m1 | | |
|---|---|---|
| | VALUE; | ERROR; |
| m1 | 1.6848 | 0.028922 |
| CHI-SQUARE | 1559.9 | NA |
| R | 0.47157 | NA |

TONER FOR DEVELOPER OF ELECTROSTATIC LATENT IMAGE, METHOD FOR PRODUCING TONER FOR DEVELOPER OF ELECTROSTATIC LATENT IMAGE, DEVELOPER OF ELECTROSTATIC LATENT IMAGE AND METHOD FOR FORMING IMAGE

BACKGROUND OF THE INVENTION

1. Field of the Invention

The present invention relates to toner for a developer of electrostatic latent image for use in such applications as electrophotography and electrostatic recording and also to a method for producing the toner as well as to a developer and an image forming method using the toner for a developer of electrostatic latent image.

2. Description of the Related Art

Electrophotography consists of the steps of forming an electrostatic charge image on a photoreceptor, developing the electrostatic charge image using an electrostatic latent image developer which comprises toner for the electrostatic latent image developer (hereinafter abbreviated as toner) , composed of a binding resin, a colorant and toner particles, transferring the toner image obtained to transfer paper, and fixing the transferred image by a heat roll or the like to obtain an image. The electrostatic latent image developers for use in such electrophotography can be roughly divided into two types, that is, a one-component developer utilizing the toner itself which comprises a colorant dispersed in a binding resin and a two-component developer which comprises a mixture of the foregoing toner and a carrier. When copying operations are carried out using these electrostatic latent image developers, from the standpoint of process adaptability such as cleaning of a photoreceptor after image formation thereon for the purpose of subsequent image formation, the electrostatic latent image developer needs to be excellent in such properties as fluidity, transportability, fixability, chargeability, transferability, and cleanability.

Recently, from the space saving standpoint, there has been a demand for the downsizing of an electrophotographic apparatus. In this regard, a system is proposed which omits the cleaning system so that the residual toner is recovered concurrently with the developing (Japanese Patent Application L Laid-Open (JP-A) No. 5-94,113). However, this system, in which the residual toner is recovered concurrently with the developing, suffers from the problem that the recovered toner remains in the developing device without being used for developing because the chargeability of the recovered toner differs from that of the other toner. Therefore, upgrading of the transferability has been required in order to omit the cleaning system.

Recently, because of a growing demand for printing in color, and in particular on-demand printing, in order to produce copies at high speed, there has been reported a method comprising the steps of forming a multicolor image on a transfer belt, transferring the multicolor image at one time to an image fixing material, and fixing the image (JP-A No. 8-115,007). However, this method presents the problem that the overall transfer of the toner is poor because residual toner is found in the primary transfer step, i.e., the transfer of toner from the photoreceptor to the transfer belt, and also in the secondary step, i.e., the transfer of toner from the transfer belt to the image fixing material. Therefore, naturally this method needs a cleaning step. Particularly in the secondary transfer, since the multicolor image needs to be transferred at one time and since the conditions of the image fixing materials vary (for example, thickness, surface property, and others in the case of paper), the improvement of the transferability of the toner itself has become important so as to minimize the influence of these conditions.

In order to improve the transferability of toner, it is necessary to minimize the distribution of chargeability between toner particles or the distribution of non-electrostatic adhesion of the toner particles. From this standpoint, it has been proposed to bring the shape of toner particles closer to a sphere so as to improve the fluidity, chargeability, and transferability of toner (JP-A No. 61-279,864). This is because the adhesion between the toner and the transfer belt or the photoreceptor decreases and therefore the transferability of the toner is improved as the shape of the toner particles approaches a sphere.

However, spherical toner particles present the following problems.

The first problem relates to the method for preparing the spherical toner particles. In a wet process for producing the spherical toner particles, a surfactant or the like is used in order to maintain the dispersibility of the particles. This surfactant is retained on the toner particles as an impurity which causes the chargeability of the toner thus obtained to be inferior to that of the toner prepared by a traditional blending/pulverizing method. In addition, for an unexplainable reason, toner particles produced by a wet process have a larger inter-particle chargeability which results in a broad distribution of the charge of particles. This phenomenon leads to the problems that a sufficient developability cannot be obtained; that non-image areas are developed; that the interior of the developing device is contaminated with toner; and that fogging by the toner increases. Another problem is that, since the nearly spherical toner particles allow the entire surface area of the particles to cause frictional electrification with carrier particles or other toner particles, the trace of impurities derived from the manufacturing process of the spherical toner particles exerts a significant influence and thus further broadens the distribution of the charge. Likewise, because of localized composition on the surface, spherical toner particles produced in a dry process have a broader distribution of charge in comparison with amorphous toner particles.

Furthermore, because of the sphericity of the toner particles, it is impossible to obtain a contacting probability and frictional strength sufficient for electrification by the friction with the carrier.

Accordingly, various attempts have been made in order to improve the chargeability of the spherical toner particles.

For example, it has been proposed to blend the spherical toner particles with an external additive which is a fine powder of an inorganic oxide such as silica in order to further improve the fluidity and the transfer efficiency of the spherical toner particles and to improve the chargeability.

As described above, for the purpose of improving the characteristics, such as fluidity, transferability, and chargeability, of toner, the use of an external additive such as a fine powder of an inorganic oxide has been hitherto known, but it is difficult to make all of the characteristics satisfactory by the external additive.

For example, if a silica fine powder which is generally known as an additive is used, despite the advantage that the fluidity of the toner is improved remarkably by use of the additive, the problem is that there occurs a large difference in chargeability depending on environmental conditions because the additive excessively increases the charge of the negatively chargeable toner in conditions of low temperature and low humidity whereas the additive absorbs moisture and thus decreases the chargeability of the toner in conditions of high temperature and high humidity. For this reason, the use of the additive cannot optimize the chargeability of the toner in both conditions, i.e., conditions of high temperature and high humidity and conditions of low temperature and low humidity, and therefore leads to problems such as poor reproduction of image density, fogging on a photoreceptor, fogging in background, and staining the device interior with the toner. For the purpose of solving these problems, a treatment to hydrophobize the surface of silica particles is proposed by, for example, JP-A Nos. 46-5,782, 48-47,345, 48-47,346, 59-34,539, 59-198,470, and 59-231,550. However, the mere use of the surface-treated inorganic fine power cannot bring about a sufficient effect in chargeability and provides no effect on the spherical toner particles produced by a wet process.

By contrast, titania which is also generally used as an additive is characterized in that the start up of charging is quicker relative to silica and that the distribution of charge is sharp probably because the titania has a low electric resistance. However, the use of the titania brings about disadvantages that a high-level of charge cannot be given to the toner and that the reduction in the amount of charge tends to decrease the reproduction of density and to cause the fogging in background.

In order to solve the problem of the reduction in the amount of charge, a method in which hydrophobic titanium oxide is used as an external additive both to two-component toner and to one-component toner (JP-A Nos. 58-216,252, 60-123,862, and 6-238,847) is proposed. According to this method, hydrophobic titanium oxide is obtained by treating the surface of the titanium oxide with a treating agent such as a silane compound, a silane coupling agent, or a silicone oil. In comparison with traditionally known hydrophilic titanium oxide, the use of the titanium oxide hydrophobized by the treating agent brings about desirable effects in terms of charge and dependence on environment. However, the disadvantage of hydrophobized titanium oxide is that the characteristics inherent to titanium oxide, such as charging speed and the sharpness of the distribution of charge, are remarkably inferior in comparison with traditionally known titanium oxide.

Conventionally,, titanium oxide is obtained mainly from titanium oxide crystals extracted from ilmenite ore by a wet process such as a sulfuric acid process or a hydrochloric acid process. Heating and firing of titanium oxide involved in the wet process naturally cause an inter-particle dehydrating condensation which leads to the formation of a chemical bond to thereby produce many flocculated particles which cannot be easily redispersed by an existing technology. That is, since the titanium oxide taken out as a fine power forms a secondary flocculation and also a tertiary flocculation, the effect of the titanium oxide on improving the fluidity of toner is significantly inferior to that of silica. Particularly, because the fluidity of toner becomes increasingly poor due to the recent use of finer toner particles associated with increased inter-particle adhesion, an additive which is inferior in the fluidity improving effect cannot be used.

In addition, the specific gravity of conventional titanium oxide is larger than that of silica. Therefore, the titanium oxide exhibits another drawback that it does not firmly adhere to the toner surface and tends to be separated from the toner surface. This drawback of the titanium oxide induces contamination of carrier and scratch of photoreceptor surface. As a result, the use of the titanium oxide leads to a poor long-term stability of chargeability and causes degradation of image quality and image defects because the photoreceptor is liable to get contaminated.

Accordingly, various proposals have been made in order to compensate the above-described drawbacks of the titanium oxide while utilizing the characteristics of the titanium oxide that the start up of charging is quick and that the distribution of the charge is sharp.

For example, in order to solve the problems of fluidity and dependence of chargeability on environment at the same time, the use of a mixture of additives, i.e., hydrophobic titanium oxide and hydrophobic silica, has been tried (JP-A No. 60-136,755).

Although this mixture temporarily inhibits the drawbacks of the hydrophobic silica and the hydrophobic titanium oxide, one of the additives tends to exert a dominant influence depending on the state of dispersion. When considering the long-term effect in particular, the stress in a developing device renders the properties of the hydrophobic silica or the hydrophobic titanium oxide more predominant because it is difficult to control the dispersion structure on toner in a stable manner. In short, it is difficult to control the drawbacks of the two additives in a stable manner for a long period of time.

Meanwhile, the addition of a hydrophobic amorphous titanium oxide to toner is proposed (JP-A Nos. 5-204,183 and 5-72,797). The hydrophobic amorphous titanium oxide can be obtained by the hydrolysis of a metal alkoxide or a metal halide by CVD (Collection of Monographs on Chemical Engineering, Vol. 18 (1992), No. 3, pp.303–307).

Although the titanium oxide obtained by hydrolysis solves the problems of the chargeability and the fluidity of toner at the same time, the titanium oxide contains in the particle thereof a large amount of adsorbed water which causes the titanium oxide itself to remain on the photoreceptor at the time of transfer. That is, the strong adhesion between the amorphous titanium oxide and the photoreceptor retains the amorphous titanium oxide alone on the photoreceptor without being transferred. This phenomenon leads to drawbacks such as image voids and formation of scratches on the photoreceptor by the hard titanium oxide at the time of cleaning.

Further, as a method for purifying titanium oxide in a wet process, it is proposed to treat the surface of titanium oxide by hydrolyzing a silane compound in an aqueous medium so as to produce titanium oxide free from flocculation, which is then added to toner (JP-A No. 5-188,633). The titanium oxide which is surface-treated with a silane compound contains a lesser amount of flocculated particles in comparison with conventional hydrophobized silica and therefore the fluidity of toner is improved. However, the titanium oxide does not change the level of charge of negatively charged toner and the dependence on environment at all in comparison with conventional hydrophobized silica. As a result, the purpose of increasing the charge of negatively charged toner and solving the problem of dependence on environment is not sufficiently achieved by the use of the titanium oxide. On the contrary, the speed of charging (admixability of adding toner) and distribution of charge are adversely affected by the titanium oxide.

In order to solve the problems, JP-A No. 6-95,429, 6-102,699, 6-266,156 and others propose the use of a specific binder resin so as to prevent the embedding of an external additive. Further, JP-A No. 6-51,561, 6-208,242, 6-250,442 and others propose the use of a specific charge controlling agent and a specific external additive.

However, none of these proposals brings about a satisfactory effect. Since a full-color developing system in which 4 color images are stacked requires accurate control of toner amounts in developing, the problem of the long-term stabilization of the amount of charge of the toner still remains to be solved.

As described above, an external additive which solves all of the problems, such as fluidity, transferability, and chargeability, has not been obtained. Particularly in the case where spherical toner particles are used, it is necessary to remarkably improve the chargeability of the toner by use of an external additive and, therefore, it is necessary to control more accurately the performance of the external additive than in the case where amorphous toner particles are used. For this reason, the control of the state in which the external additive adheres to the toner is also necessary in addition to the control of the kind and particle diameter of the external additive.

JP-A No. 1-185,654 describes the relationship between the central values indicative of shape of toner and carrier instead of specifying the external additive. According to JP-A No. 1-185,654, if the relationship lies in a specific range, a sharp start-up of charging of toner and a sharp distribution of charge of toner can be obtained. However, one problem involved is that the shape of carrier or toner needs to be close to amorphousness in order to fulfill the condition of JP-A No. 1-185,654, and transfer efficiency becomes poor as the shape of carrier or toner approaches amorphousness. Another problem is that, as the shape of carrier approaches amorphousness, the stress of the amorphous carrier becomes larger than that of spherical carrier in a developing device and the larger stress thus created tends to separate the coating agent from the carrier to an extent that it is difficult for the carrier to exhibit a stable chargeability for a long period of time. In addition, even if the condition of JP-A No. 1-185,654 is met, toner having a shape close to a sphere cannot exhibit a satisfactory chargeability.

The present invention has been made based on the above-described state of prior art.

Accordingly, a first object of the present invention is to provide toner for an electrostatic latent image developer, said toner being excellent in fluidity, transferability, and chargeability and being free from the problems of poor developing, fogging on photoreceptor, and contamination of the interior of developing device, and also to provide a method for producing the toner as well as to provide an electrostatic latent image developer and an image forming method using the toner.

A second object of the present invention is to provide an image forming method which can omit a cleaning step.

SUMMARY OF THE INVENTION

The toner for an electrostatic latent image developer of the present invention comprises at least toner particles composed of a binding resin and a colorant and one or more external additives, wherein the toner particles are spherical particles having a shape index $ML^2/A$ of less than 125 and wherein the correlation coefficient between $X^{2/3}$ and Y by linear regression with respect to a straight line which passes through the origin of coordinate axes is more than 0.6 where X is the light emitting voltage due to the carbon derived from the binding resin of the toner particles and Y is the light emitting voltage due to the element derived from the external additive.

It is preferable that the toner contain two or more external additives as the external additive. It is also preferable that the toner contain at least one external additive whose BET specific surface area is in the range of from 20 to 250 $m^2/g$. Further, it is preferable to use an external additive which is selected from the group consisting of silica, titanium compounds, alumina, cerium oxide, calcium carbonate, magnesium carbonate, calcium phosphate, fluorine-containing resin particles, silica-containing resin particles, and nitrogen-containing resin particles. Examples of the titanium compounds which are usable in the present invention include strontium titanate, titanium oxide, and titanate compounds. Among these compounds, the most preferable is a titanium compound which has a specific gravity in the range of from 2.8 to 3.6 and which is obtained by reacting a silane compound or a silicone oil with a part or the whole of the $TiO(OH)_2$ produced by a wet process.

Furthermore, the total of Y derived from the particles present on a straight line of $X^{2/3}=0$ is preferably 5% or less of the total of Y derived from other particles, where X is the light emitting voltage due to the carbon derived from the binding resin of the toner particles and Y is the light emitting voltage due to the element derived from the external additive.

The method for preparing toner for an electrostatic latent image developer of the present invention comprises mixing the toner particles with the external additive, wherein the mixing is performed in a two-step operation, i.e., a pre-mixing operation using a weaker energy and a final mixing operation using of a stronger energy.

When the toner particles are mixed with the external additive, the external additive is preferably added stepwise. Where two or more external additives are added, it is preferable to add the additives in the form of a blend thereof prepared in advance.

The electrostatic latent image developer of the present invention comprises the toner for an electrostatic latent image developer of the present invention. The electrostatic latent image of the present invention developer may be a two-component developer which comprises a mixture of carrier and toner, wherein the carrier is preferably coated with a resin layer.

The image forming method of the present invention comprises a step of developing an electrostatic image on a carrier for a latent image using a developer and a step of transferring the toner image thus formed to a transfer-receiving medium, wherein the electrostatic latent image developer of the present invention is used as the developer. The image forming method of the present invention may omit a cleaning step. Further, the image forming method of the present invention can be used as a color image forming method comprising the steps of forming a multicolor image on a transfer belt by transfer of the images obtained and then transferring the multicolor image at one time to a transfer-receiving medium.

DETAILED DESCRIPTION OF THE INVENTION

Figure 1:
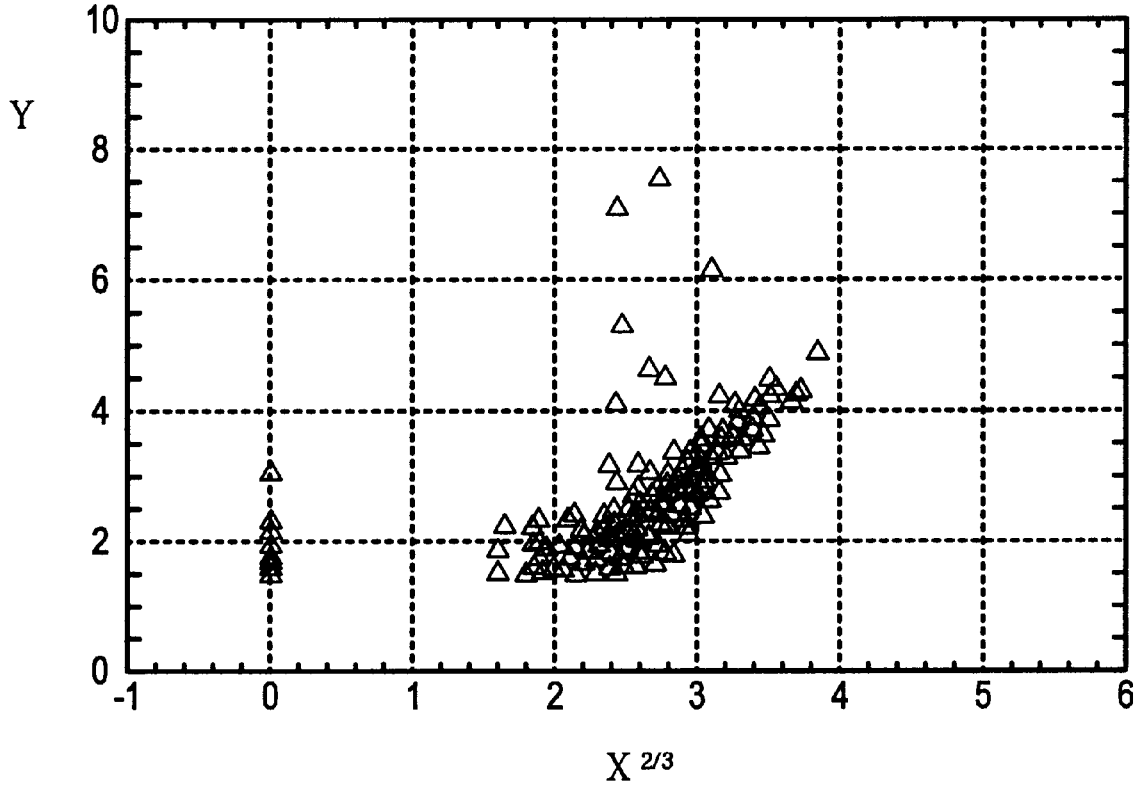
FIG. 1 is a diagram indicating the relationship between $X^{2/3}$ and Y in the electrostatic latent image developer according to the present invention where X is the light emitting voltage due to the carbon derived from the binding resin of the toner particles and Y is the light emitting voltage due to the element (Ti) derived from the external additive.

The toner for an electrostatic latent image developer of the present invention comprises at least toner particles and one or more external additive, wherein the toner particles contain a binding resin and a colorant.

(toner particles)

The toner particles for use in the present invention are spherical particles having a shape index $ML^2/A$ of less than 125.

The term "shape index $ML^2/A$" as used herein is a percentage obtained by dividing the projected area of a toner particle whose maximum diameter is ML by the real projected area A of the toner particle. The shape index is calculated as $ML^2/A=(\text{maximum diameter})^2\times\pi\times100/(\text{area}\times4)$. The shape index $ML^2/A$ is 100 if the particle is a true sphere. In other words, the toner particle becomes closer to a true sphere as the shape index approaches 100, whereas the degree of the flatness of the toner particle increases and therefore the amorphousness of the toner increases as the shape index exceeds 100. For example, the conventional amorphous toner particles prepared by blending/pulverizing have a shape index $ML^2/A$ of 140 or more.

Accordingly, toner particles having a shape index $ML^2/A$ of more than 125 are not desirable, because the shape of such toner particles is close to amorphousness and therefore the fluidity and transferability of such toner particles are not improved.

In the present invention, the values of shape indexes $ML^2/A$ were measured by a procedure comprising observing the toner particles under an optical microscope (Nikon Microphoto-FXA manufactured by Nikon Corp.) and then providing an image magnified 250 times into an image analyzing apparatus (LUZEX III manufacture by Nireco Corp.)

A method for producing spherical toner particles having a shape index $ML^2/A$ of less than 125 is not particularly limited in so far as toner particles whose shape index is in this range are produced. Although known methods can be adopted, examples of typical methods include a method comprising emulsion-polymerization and flocculation wherein an emulsion of a binding resin is prepared by emulsion-polymerizing polymerizable monomers thereof and then a mixture, which comprises the emulsion, a colorant and optionally a dispersion liquid comprising a release agent, a charge controlling agent, an offset preventing agent, or the like, is flocculated/fused by heating to thereby produce toner particles; a suspension polymerization wherein a mixture, which comprises polymerizable monomers for obtaining a binding resin, a colorant and optionally a solution comprising a release agent, a charge controlling agent, an offset preventing agent, or the like, is suspended in an aqueous medium and the polymerization is performed in the resulting suspension; and a method comprising dissolution and suspension wherein a mixture, which comprises a binding resin, a colorant and optionally a solution comprising a release agent, a charge controlling agent, an offset preventing agent, or the like, is suspended in an aqueous medium and then the suspension is processed to provide granules.

Other methods include a method comprising the steps of obtaining amorphous toner particles by blending a binding resin, a colorant and optionally a release agent, a charge controlling agent, an offset preventing agent, or the like, followed by pulverizing and classifying, and changing the shape of the amorphous toner particles by imparting mechanical impact or thermal energy to the amorphous toner particles; and a method wherein the toner particles obtained in the foregoing method are used as cores to which flocculating particles are caused to adhere and the resulting particles are thermally fused to thereby form a core/shell structure.

Examples of the binding resin for use in the present invention include homopolymers and copolymers which are made up of styrenes, such as styrene and chlorostyrene, monoolefins, such as ethylene, propylene, butylene, and isoprene, vinyl esters, such as vinyl acetate, vinyl propionate, vinyl benzoate, and vinyl butyrate, esters of an α-methylene aliphatic monocarboxylic acid, such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate, vinyl ethers, such as vinyl methyl ether, vinyl ethyl ether, and vinyl butyl ether, and vinyl ketones such as vinyl methyl ketone, vinyl hexyl ketone, and vinyl isopropenyl ketone. Typical examples of the binding resin are polystyrene, styrene/alkyl acrylate copolymers, styrene/alkyl methacrylate copolymers, styrene/acrylonitrile copolymers, styrene/butadiene copolymers, styrene/maleic anhydride copolymers, polyethylene, and polypropylene. Other examples include polyesters, polyurethanes, epoxy resins, silicone resins, polyamides, modified rosins, and paraffin waxes.

Typical examples of the colorant for use in the present invention are a dye or a pigment such as carbon black, aniline blue, chalcoyl blue, chrome yellow, ultramarine blue, Dupont oil red, quinoline yellow, methylene blue chloride, phthalocyanine blue, malachite green oxalate, lamp black, rose bengal, C.I. Pigment Red 48:1, C.I. Pigment Red 122, C.I. Pigment Red 57:1, C.I. Pigment Yellow 97, C.I. Pigment Yellow 17, C.I. Pigment Blue 15: 1, and C.I. Pigment Blue 15:3.

If necessary, the toner particles of the present invention may contain a release agent or a charge controlling agent for the purpose of preventing offset in addition to the binding resin and the colorant.

Examples of the release agent include a wax such as polypropylene having a low molecular weight and polyethylene having a low molecular weight.

Any known charge controlling agent can be used in the present invention. Among the known agents, particularly suited for use in the present invention are azo-based complex compounds of metals, complex compounds made up of salicylic acid and a metal, and resinous compounds having a polar group. From the standpoint of the control of ionic strength and the prevention of the contamination of waste water, it is desirable that the charge controlling agent has a low solubility in water when the toner particles are produced in a wet process.

When the toner particles of the present invention are produced in a wet process, a surfactant may be added in order to improve the dispersibility of the resin particles, the pigment, and the release agent. Examples of the surfactant include anionic surfactants, such as sulfuric ester salts, sulfonates, phosphoric ester type soaps, cationic surfactants, such as amine salts and quaternary ammonium salts, and nonionic surfactants such as polyethylene glycols, alkylphenol/ethylene oxide adducts, and polyhydric alcohols. It is effective to use these surfactants in a combination of two or more.

As in the case of conventional toner particles, the average particle diameter of the toner particles of the present invention is preferably in the range of from 3 to 10 μm, and more preferably in the range of from 4 to 8 μm. If the average particle diameter is more than 10 μm, the reproduction of photographic images or the reproduction of fine lines may be inferior because the toner particles do not faithfully develop the latent image in dots and lines. On the other hand, if the average particle diameter is less than 3 μm, a stable image may not be obtained because the surface area per unit toner amount becomes larger and therefore control of the chargeability and the fluidity of the toner becomes difficult.

A wet process using an external additive, in which a small amount of an external additive is added to the dispersion liquid of toner particles during the production of the toner particles, is preferable, because this process improves the fluidity of the toner particles by reducing the flocculation of the toner particles and facilitates the homogenous mixing of the toner particles and the external additive.

(External additives)

Any known external additives, such as inorganic or organic particles, can be used in the present invention. Among these known external additives, particularly suited for use in the present invention are inorganic particles, such as silica, titania, alumina, cerium oxide, strontium titanate, calcium carbonate, magnesium carbonate, and calcium phosphate, and organic resin particles such as fluorine-containing resin particles, silica-containing resin particles, and nitrogen-containing resin particles.

Depending on the purpose, these external additives may be surface-treated. Examples of the surface-treating agent include a hydrophobizing agent such as a silane compound, a silane coupling agent, or a silicone oil.

Among these compounds, the most preferable is a titanium compound which has a specific gravity in the range of from 2.8 to 3.6 and which is obtained by reacting a silane compound or a silicone oil with a part or the whole of the $TiO(OH)_2$ produced by a wet process.

First, the manufacturing process for $TiO(OH)_2$ is described below. The $TiO(OH)_2$ which is a raw material for the titanium oxide for use in the present invention is produced by an ordinary wet process comprising a chemical reaction in a solvent. The wet process can be divided into a wet process by sulfuric acid and a wet process by hydrochloric acid, as described below.

To put it briefly, in the wet process by sulfuric acid, the reaction proceeds in a liquid phase to produce insoluble $TiO(OH)_2$ by hydrolysis:

$$FeTiO_3+2H_2SO_4 \rightarrow FeSO_4+TiO\ SO_4+2H_2O\ TiO\ SO_4+2H_2O \rightarrow TiO(OH)_2+2H_2SO_4$$

On the other hand, in the wet process by hydrochloric acid, titanium tetrachloride, which is produced by the same procedure as in a dry process, is dissolved in water and is then hydrolyzed to produce $TiO(OH)_2$ by using a strong base. The reaction is briefly described as follows:

$$TiCl_4+H_2O \rightarrow TiOCl_2+2HCl\ TiOCl_2+2H_2O \rightarrow TiO(OH)_2+2HCl$$

Next, a part or the whole of the $TiO(OH)_2$ thus produced is treated with a silane compound or a silicone oil. This treatment is intended for imparting hydrophobicity and for preventing the flocculation of the titanium compound.

As described above, the titanium compound thus obtained has not undergone a calcination step which is performed at a temperature as high as several hundreds degrees C. As a result, the titanium compound thus obtained is free from a strong bond between Ti atoms and is entirely free from flocculation. Therefore, the particles produced are mostly primary particles.

According to the above-described treatment, since the silane compound as a treating agent is directly reacted with the $TiO(OH)_2$, the amount of the treating agent reacted can be increased. In addition, in contrast with titanium oxide treated in a conventional way in which the maximum effective amount of the treating agent is low in terms of contribution to the chargeability, the titanium compound for use in the present invention has an advantage that the maximum effective amount of the treating agent is high and therefore the effect thereof increases until the amount thereof increases up to a value which is 3 times (i.e., about 50 to 70% of the base titanium compound) that of conventional titanium compound although the amount varies depending on the diameters of the base titanium compound.

That the specific gravity of the titanium compound obtained by the above-described procedure is as low as 2.8 to 3.6 supports the fact that the titanium compound is perfectly free from flocculation. The use of an external additive which is free from flocculation makes it possible to uniformly coat the surface of the toner particles with a smaller amount of the additive. Accordingly, since the coating amounts of the additive vary little between toner particles, it is possible to control the charge of toner particle by the amount of the silane compound or the silicone oil used in the treatment and also to remarkably improve the chargeability to be imparted to the toner particles in comparison with conventional titanium oxide. If the specific gravity of the titanium compound is less than 2.8, it is necessary to use the treating agent in an excessive amount which tends to cause a side reaction between the silane compounds and tends to produce flocculations. As a result, the fluidity and chargeability of the toner particles may become poor. On the other hand, if the specific gravity of the titanium compound is more than 3.6, the titanium compound may be localized on the toner particle because the weight of the titanium compound tends to cause flocculations thereof.

The specific gravity of the titanium compound was measured by using a Le Chatelier's pycnometer in accordance with JIS K 0061, 5-2-1. The procedure is as follows:

(1) Fill a pycnometer with about 250 ml of water and adjust the meniscus so as to be within the range of graduation.

(2) Immerse the pycnometer in a thermostatic bath and accurately read the position of the meniscus by the graduation on the pycnometer when the temperature of the liquid reaches 20.0±0.2° C. (accuracy should be 0.025 ml).

(3) Weight out about 100 g of the sample to the nearest 1 mg and designate the mass as W.

(4) Place the sample in the pycnometer and eliminate the bubbles.

(5) Immerse the pycnometer in a thermostatic bath so that the temperature of the liquid is kept at 20.0±0.2° C. and accurately read the position of the meniscus by the graduation on the pycnometer (accuracy should be 0.025 ml).

(6) Calculate the specific gravity of the sample according to the following formulas:

$$D=W/(L2-L1)$$

$$S=D/0.9982$$

where D, S, W, L1, L2, and the number of 0.9982 are defined as follows:

D: density of sample (20° C.) (g/cm$^3$)

S: specific gravity of sample (20/20° C.)

W: apparent mass of sample (g)

L1: reading of meniscus before placing the sample in the pycnometer (20° C.) (ml)

L2: reading of meniscus after placing the sample in the pycnometer (20° C.) (ml)

0.9982: density of water at (20° C.)

The average diameter of primary particles of the titanium compound of the present invention is preferably 100 nm or less, and more preferably in the range of from 10 to 70 nm.

The use of this titanium compound as a first external additive is desirable because the flocculation of the titanium compound is slight and the coating amounts of the titanium compound vary little between toner particles.

The type and particle diameter of the external additives are selected appropriately according to their purpose. For example, the adhesion between toner particles is desirably reduced by a combination of an external additive having a larger particle diameter and an external additive having a smaller particle diameter.

For example, the recent demand for a high-quality image requires the use of toner having a smaller diameter, which inevitably brings about an increase in adhesion between toner particles and thus poor transfer of toner. In order to solve this problem, it is preferable to use at least one external additive having a larger particle diameter.

An external additive having a larger particle diameter means an external additive whose BET specific surface area is in the range of from 20 to 250 m$^2$/g, and external additives which have undergone various surface treatments can be used in the present invention if the BET specific surface area is in this range. More preferably, the BET specific surface area is in the range of from 20 to 100 m$^2$/g. If the surface area is less than 20 m$^2$/g, the disadvantages are that non-uniformity is likely to occur in images because of a decrease in the fluidity of toner and that scratches on the photoreceptor and holes in images are likely to occur because the additive is easily separated from the toner particles as a result of poor adhesion between the additive and the toner particles. On the other hand, if the surface area is more than 250 m$^2$/g, the disadvantages are that the expected effect of the additive as an aid in transfer cannot be fully exhibited and that poor transfer is likely to occur particularly in the lowermost layer of toner.

The amount added of the external additive having the larger particle diameters is preferably 0.1 to 5.0 parts by weight, and more preferably 0.2 to 2.0, per 100 parts by weight of the toner. If the amount added is less than 0.1 parts by weight, the problem of poor transfer cannot be completely solved, whereas, if the amount added is more than 5.0 parts by weight, the additive is easily separated from the toner particles, thus leading to the formation of scratches on the photoreceptor and holes in images.

In particular, in order to decrease the adhesion between toner particles, it is preferable to use more than one external additives so that at least one thereof has a different particle diameter.

The amount added of the above-described external additive is preferably 0.05 to 10 parts by weight, more preferably 0.1 to 5.0, per 100 parts by weight of the toner. If the amount added is less than 0.05 parts by weight, the effect of the additive cannot be fully exhibited, whereas, if the amount added is more than 10 parts by weight, a larger proportion of the additive is easily separated from toner particles, thus leading to the problems of insufficient charge, contamination of carrier, scratches on the photoreceptor, or others.

The total amount of the external additive calculated with respect to the amount of toner is preferably a large amount in order that the additive can be uniformly adhered to the toner particles. However, the total amount of the external additive is appropriately determined by taking into account the balance of factors such as chargeability, characteristics of the powder, costs, flocculation of the external additive, defects due to the separated external additive, and the like.

(Toner for a developer of electrostatic latent image)

As described above, the toner for an electrostatic latent image developer according to the present invention is composed of toner particles and an external additive. Since the state of adhesion between the external additive and the toner particles is important in the present invention, the state of adhesion is specified by the correlation coefficient between $X^{2/3}$ and Y by linear regression with respect to a straight line which passes through the origin of coordinate axes where X is the light emitting voltage due to the carbon derived from the binding resin of the toner particles and Y is the light emitting voltage due to the element derived from the external additive.

Figure 2:
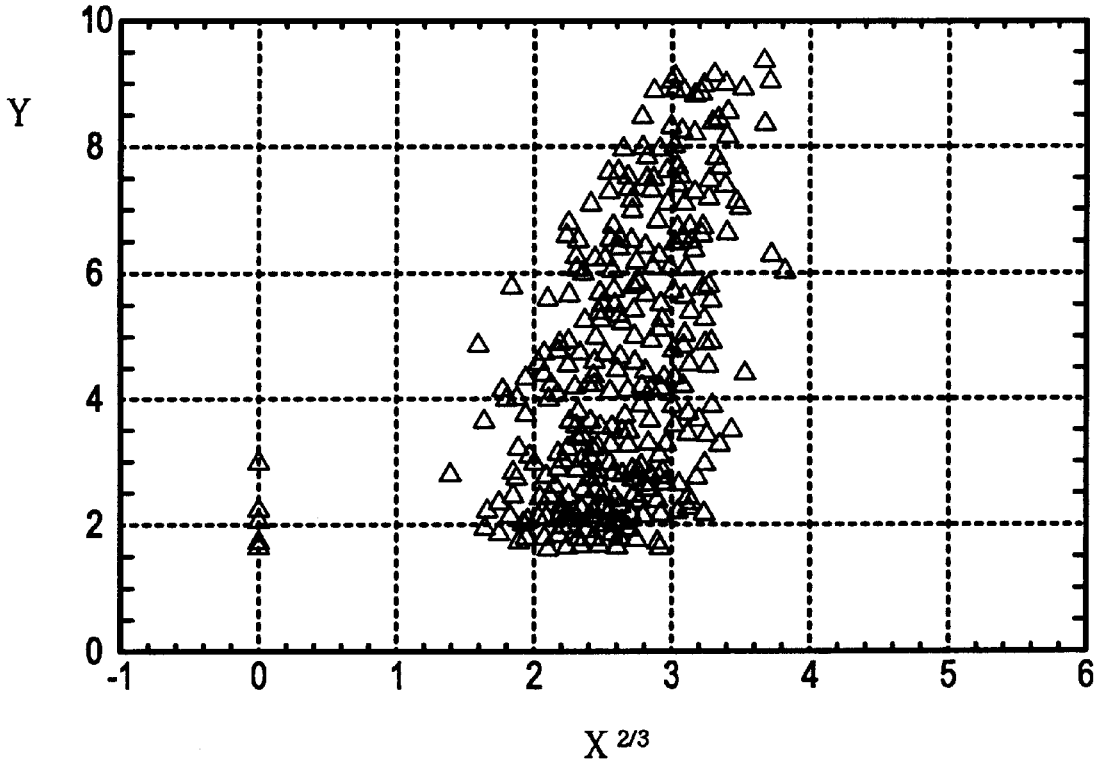
FIG. 2 is a diagram indicating the relationship between $X^{2/3}$ and Y in a conventional electrostatic latent image developer using amorphous toner where X is the light emitting voltage due to the carbon derived from the binding resin of the toner particles and Y is the light emitting voltage due to the element (Ti) derived from the external additive.
Figure 3:
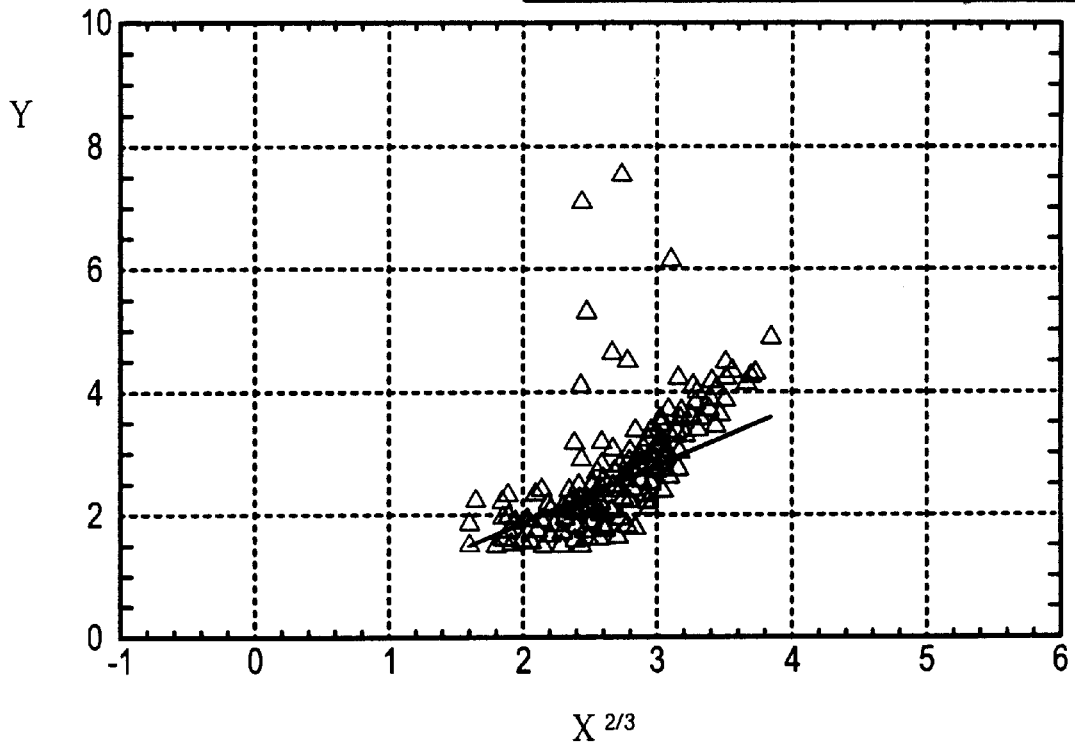
FIG. 3 is a diagram indicating the relationship between $X^{2/3}$ and Y in the electrostatic latent image developer according to the present invention by linear regression with respect to a straight line which passes through the origin of coordinate axes where X is the light emitting voltage due to the carbon derived from the binding resin of the toner particles and Y is the light emitting voltage due to the element (Ti) derived from the external additive.
Figure 4:
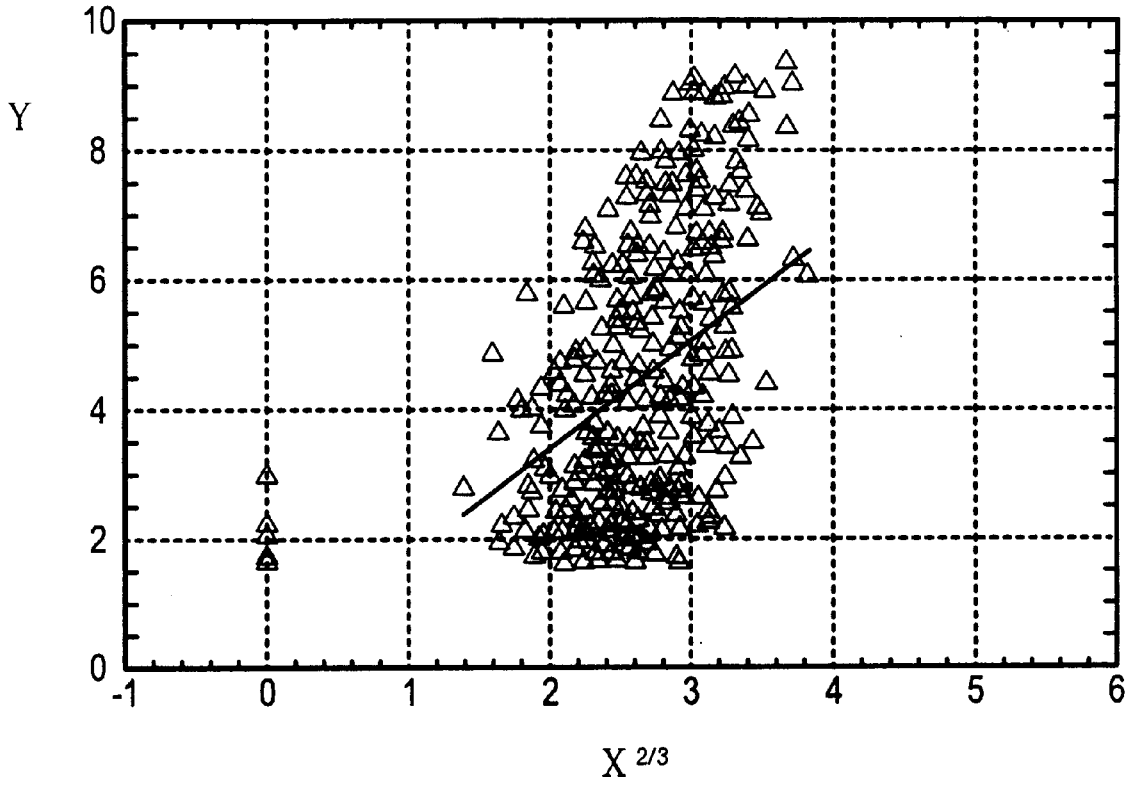
FIG. 4 is a diagram indicating the relationship-between $X^{2/3}$ and Y in a conventional electrostatic latent image developer using amorphous toner by linear regression with respect to a straight line which passes through the origin of coordinate axes where X is the light emitting voltage due to the carbon derived from the binding resin of the toner particles and Y is the light emitting voltage due to the element (Ti) derived from the external additive.

Now, the method for obtaining the correlation coefficient and the meaning thereof in the present invention are explained by referring to correlation diagrams. FIGS. 1 and 3 are each a diagram indicating the relationship between $X^{2/3}$ and Y in the electrostatic latent image developer according to the present invention where X is the light emitting voltage due to the carbon derived from the binding resin of the toner particles and Y is the light emitting voltage due to the element (Ti) derived from the external additive. FIGS. 2 and 4 are each a diagram indicating the relationship between $X^{2/3}$ and Y in a conventional electrostatic latent image developer using amorphous toner where X is the light emitting voltage due to the carbon derived from the binding resin of the toner particles and Y is the light emitting voltage due to the element (Ti) derived from the external additive.

By using a particle analyzer (PT-1000 manufactured by Yokogawa Electric Corp.) designed for elemental analysis by means of the light emitting voltage of each element, the present inventors conducted elemental analysis of each toner particle. In this way, they measured the light emitting voltage X due to the carbon derived from the binding resin of the toner particles and the light emitting voltage Y due to the element (Ti) derived from the external additive for about 1,000 units of the toner particles. Based on these data, they calculated $X^{2/3}$ and obtained the relationship between $X^{2/3}$ and Y, which were plotted as shown in FIGS. 1 and 2.

In FIGS. 1 and 2, qualitatively each plot indicates a toner particle so that $X^{2/3}$ for the plot represents the surface area of the toner particle and Y for the plot represents the amount of the external additive adhered to the toner particle.

FIGS. 3 and 4 are prepared by superposing a straight line which is represented by a regression equation $Y=a(X^{2/3})$ and passes through the origin of coordinate axes on FIGS. 1 and 2, respectively. The coefficient a in the equation $Y=a(X^{2/3})$ can be obtained by least square approximation. If the plots are on this straight line, it is understood that the external additive is uniformly adhered to toner particles proportionately to the surface areas of the toner particles.

As can be seen from the comparison between FIG. 3 and FIG. 4, the plots are almost on the straight line in the case of the electrostatic latent image developer according to the present invention. On the other hand, deviation from the straight line is remarkable in the case of the conventional electrostatic latent image developer utilizing amorphous toner. The deviation is quantitatively indicated by the correlation efficient.

Based on the date described above, the correlation coefficient (r) derived from element of the external additive was determined by a linear regression of $X^{2/3}$ and Y with respect to a straight line which passes through the origin of coordinate axes.

More specifically, the correlation coefficient (r) can be obtained from the following equations (1) to (6), where n is the number of particles when X was measured, while m is the number of particles when Y was measured.

$$r=S(XY)/(S(XX)\times S(YY))^{0.5} \quad \text{equation (1)}$$

$$S(XY)=\Sigma(X-\alpha)/(X-\beta) \quad \text{equation (2)}$$

$$S(XX)=\Sigma(X-\alpha)^2 \quad \text{equation (3)}$$

$$S(YY)=\Sigma(X-\beta)^2 \quad \text{equation (4)}$$

$$\alpha=(X_1+X_2+X_3+\ldots X_n)/n \quad \text{equation (5)}$$

$$\beta=(Y_1+Y_2+Y_3+\ldots Y_n)/n \quad \text{equation (6)}$$

When calculating the regression equation, since the absence of a particle of Y=0 (particle to which entirely no external additive adheres) was confirmed by observation under an SEM, such a particle was regarded as out of measurement scope and excluded from the calculation. In FIGS. 1 to 4, particles of Y=0 were excluded from plotting. Likewise, a particle of $X^{2/3}=0$ was regarded as a particle composed of an external additive alone and such a particle was also excluded from the calculation of the regression equation and the correlation coefficient (r).

The correlation coefficient (r) is obtained by the above-described method and varies within the range of $-1>r>1$. As the difference in adhesion of the external additive between toner particles is reduced, the value of the correlation coefficient approaches 1.0.

In the present invention, the value of the correlation coefficient needs to be more than 0.6, and the value of the correlation coefficient is preferably close to 1.0. If the value of the correlation coefficient is less than 0.6, the charge distribution is abruptly broadened accompanied by the problems that a sufficient developing performance cannot be obtained; that non-image areas are developed; and that the amount of fogging toner increases.

Furthermore, the total of Y derived from the particles present on a straight line of $X^{2/3}=0$ is preferably 5% or less of the total of Y derived from other particles, where X is the light emitting voltage due to the carbon derived from the binding resin of the toner particles and Y is the light emitting voltage due to the element derived from the external additive.

Y derived from the particles present on a straight line of $X^{2/3}=0$ means light emitting voltage Y due to the element derived from the external additive which does not adhere to the toner particles and therefore is isolated. That the total of Y present on a straight line of $X^{2/3}=0$ is 5% or less of the total of Y means that the amount of the external additive, which does not adhere to the toner particles and therefore is isolated, is 5% or less of the amount of the external additive which adheres to the toner particles. That is, the smaller this percentage, the smaller the amount of the external additive, which does not adhere to the toner particles and therefore is isolated. Accordingly, the smaller this percentage, the more effectively the external additive is used. If the percentage exceeds 5%, problems such as contamination of the carrier or scratches on the photoreceptor emerge.

A method for preparing toner for an electrostatic latent image developer generally comprises mixing the toner particles with the external additive so that the external additive adheres to the surface of the toner particles. However, the method for preparing toner for an electrostatic latent image developer according to the present invention comprises mixing the toner particles with the external additive in a two-step operation, i.e., a pre-mixing operation using a small amount of energy and a final mixing operation using a large amount of energy.

If the mixing operation is started using a large amount of energy, the external additive cannot uniformly adhere to all toner particles, because the external additive present in the vicinity of the toner particles exclusively adheres to the toner particles and because the external additive having a low apparent density floats. In order to allow the external additive to uniformly adhere to the toner particles, it is important to perform the mixing in a two-step operation, i.e., a pre-mixing operation using a small amount of energy to ensure uniform mixing of the toner particles and the external additive and thereafter a final mixing operation to adhere the external additive to the toner particles using a large amount of a stronger energy.

The mixing operation using less energy means a mixing operation which is performed using ½ to 1/10 of the energy to be used in the mixing operation using more energy. For example, the mixing operation using less energy can be performed by setting the peripheral speed of a revolving blade to a value within the range of ½ to 1/10 of the peripheral speed of a revolving blade of the mixing operation using more energy. The mixing operation using a large amount of energy means a mixing operation using an amount of energy which enables the external additive to adhere to the toner particles without being easily separated therefrom in processes ranging from developing to cleaning. The mixing operation using more energy can be achieved by carrying out the mixing operation for a longer period of time by employing a higher peripheral speed relative to the mixing operation using less energy.

The mixing can be performed using a known mixer. Examples of the suitable mixer include a Henschel mixer and a homogenizer.

Where a single external additive is used, the whole amount of the additive may be added at one time. However, it is preferable to add the external additive stepwise in portions from the standpoint of reducing the difference in the coating amounts of the external additive between toner particles. Every time the external additive is added, it is necessary to carry out the mixing in a two-step operation, i.e., a pre-mixing operation using a small amount of energy and a final mixing operation using a large amount of energy.

Where a plurality of external additives are added, although the additives may be consecutively added, it is preferable to add the additives in the form of a blend thereof prepared in advance in order to allow the additives to adhere uniformly to the toner particles. In any case, it is preferable to add the external additive stepwise in portions as in the case where a single external additive is used.

It must be noted, however, that, every time the external additive is added, it is necessary to carry out the mixing in a two-step operation, i.e., a pre-mixing operation using a small amount of energy and a final mixing operation using a large amount of energy.

(Electrostatic latent image developer)

The toner for an electrostatic latent image developer according to the present invention can become a magnetic one-component toner and can be used as a one-component developer if whole or part of the black colorant of the toner for the electrostatic latent image developer is replaced with a magnetic powder. Examples of the magnetic powder include powders of magnetite, ferrite, metals such as cobalt, iron, and nickel, and alloys of these metals.

Further, the toner for the electrostatic latent image developer according to the present invention can become a two-component developer if the toner for the electrostatic latent image developer is combined with a carrier. In this case, the carrier is preferably a resin-coated carrier comprising a core material coated with a resin layer. Alternatively, the carrier may comprise an electroconductive material dispersed in a coating resin or a matrix resin.

Some illustrative nonlimiting example of the coating resin or the matrix resin include polyethylene, polypropylene, polystyrene, polyacrylonitrile, polyvinyl acetate, polyvinyl alcohol, polyvinyl butyral, polyvinyl chloride, polyvinyl carbazole, polyvinyl ether, polyvinyl ketone, vinyl chloride/vinyl acetate copolymers, styrene/acrylic acid copolymers, straight silicone resins composed of organosiloxane linkage or modified products thereof, fluorine-containing resins, polyester, polyurethane, polycarbonate, phenolic resins, amino resins, melamine resins, benzoguanamine resins, urea resins, amido resins, and epoxy resins.

Some illustrative nonlimiting examples of the electroconductive material to be contained in the resins include powder of metals, such as gold, silver, and copper, carbon black, and fine powder of inorganic materials such as titanium oxide, zinc oxide, barium sulfate, aluminum borate, potassium titanate, and tin oxide.

Examples of the core forming material of the carrier include a magnetic metal such as iron, nickel, or cobalt, a magnetic oxide such as ferrite or magnetite, and glass beads. From the standpoint of adjusting the volume resistivity for use in a magnetic brush method, the core forming material of the carrier is preferably a magnetic material.

The average particle diameter of the core forming material of the carrier is generally 10 to 500 pm, and the core forming material of the carrier is preferably in the shape of a sphere having a diameter in the range of from 30 to 100 $\mu$m.

Examples of the method for coating the core forming material of the carrier with the resin include immersion wherein the core forming material of the carrier is immersed in a solution for forming the coating layer, spraying wherein the core forming material of the carrier is sprayed with a solution for forming the coating layer, spraying in a fluidized bed wherein the core forming material of the carrier is floated by fluidizing air and is sprayed with a solution for forming the coating layer, and coating in a kneader coater wherein the core forming material of the carrier is mixed with a solution for forming the coating layer in a kneader coater and the solvent is then removed.

The image forming method of the present invention comprises a step for developing an electrostatic latent image on a carrier for the electrostatic latent image by using a developer layer and a step for transferring the toner image formed to a transfer-receiving medium.

The step for developing an electrostatic latent image on a carrier for the electrostatic latent image by using a developer layer is not particularly limited in so far as the toner for the electrostatic latent image developer according to the present invention is used in the developer. The step itself is a generally known process which uses a photoreceptor in electrophotography or a dielectric recorder as a carrier for the electrostatic latent image so that an electrostatic latent image is formed by a known method. For example, the carrier for developer comprises a rotatable nonmagnetic sleeve having a magnetic roll fixed therein. The carrier for the developer is disposed in a position opposite to the carrier for the electrostatic latent image. The toner image formed on the carrier for the electrostatic latent image is transferred to a transfer-receiving medium by a known step and the transferred image is fixed by means of a heat roll. The image forming method of the present invention can be performed by an image forming apparatus which itself is known and is exemplified by a copying machine or a facsimile machine.

The image forming method of the present invention can be used as a system which does not involve a cleaning step for removal of the residual toner on the carrier for the electrostatic latent image and which recovers the residual toner concurrently with developing, because the electrostatic latent image developer according to the present invention has excellent chargeability and remarkably improved toner transfer efficiency, and therefore produces no waste toner, as has been previously set forth.

Further, the image forming method of the present invention can be used as a color image forming method comprising a step for forming a multicolor image on a transfer belt and a step for transferring at one time the multicolor image thus formed to a transfer-receiving medium as a step for transferring a toner image to the transfer-receiving medium.

EXAMPLES

The present invention will be further clarified by the following examples, which should not be viewed as a limitation on any embodiment of the invention. "Part" in the following examples is "part by weight" unless otherwise specified.

Preparation of external additives A and B

External additives A and B were prepared in the following ways.

[Preparation of external additive A]

100 parts of $TiO(OH)_2$ and 40 parts of isobutyltrimethoxysilane were mixed together and the mixture was caused to react by heating. The reaction product was washed with water, filtered and dried at 120° C. Then, the powder thus obtained was ground in a pin mill to destroy soft flocculation. In this way, an external additive A having a particle diameter of 45 nm and a specific gravity of 3.2 was obtained. $TiO(OH)_2$ as the material was produced by a wet precipitation process comprising dissolving ilmenite ore in sulfuric acid to remove iron and hydrolyzing $TiOSO_4$ to thereby produce $TiO(OH)_2$.

[Preparation of external additive B]

The same $TiO(OH)_2$ as in the preparation of external additive A was used. The $TiO(OH)_2$ was washed with water, filtered and calcined to thereby obtain titanium oxide having a particle diameter of 30 nm. Then, the powder thus obtained was ground in a jet mill. The powder was dispersed in water and 40 parts of isobutyltrimethoxysilane, calculated with respect to 100 parts of the titania, was added to the dispersion. The resulting dispersion was wet-ground in a sand grinder. Next, the dispersion was stirred and dried in a kneader under heating. In this way, an external additive B having a specific gravity of 3.9 was obtained. Preparation of toner particles A, B. and C Toner particles A, B, and C were prepared in the following ways.

[Preparation of toner particles A]

(Preparation of resin dispersion liquid (1))

| | |
|---|---|
| styrene | 370 g |
| n-butyl acrylate | 30 g |
| acrylic acid | 8 g |
| dodecanethiol | 24 g |
| carbon tetrabromide | 4 g |

A mixture comprising the above ingredients for a binding resin was dispersed and emulsified in 550 g of ion-exchanged water containing 6 g of a nonionic surfactant (Nonipole 400 manufactured by Sanyo Chemical Industries, Ltd.) and 10 g of an anionic surfactant (Neogen SC manufactured by Daiichi Kogyo Seiyaku Co., Ltd.) in a flask, which was gently agitated for 10 minutes and admixed with 50 g of ion-exchanged water containing 4 g of ammonium persulfate and thereafter the flask interior was purged with a nitrogen gas. The contents were continuously agitated gently and were heated to 70° C. by means of an oil bath, and the emulsion polymerization was continued in this state for 5 hours. In this way, there was prepared a resin dispersion liquid (1) which had an average particle diameter of 155 nm and which comprised particles of a resin having a glass transition point (Tg) of 59° C. and a weight average molecular weight (Mw) of 12,000.

(Preparation of resin dispersion liquid (2))

| | |
|---|---|
| styrene | 280 g |
| n-butyl acrylate | 120 g |
| acrylic acid | 8 g |

A solution comprising the above ingredients for binding resin was dispersed and emulsified in 550 g of ion-exchanged water containing 6 g of a nonionic surfactant (Nonipole 400 manufactured by Sanyo Chemical Industries, Ltd.) and 12 g of an anionic surfactant (Neogen SC manufactured by Daiichi Kogyo Seiyaku Co., Ltd.) in a flask, which was gently agitated for 10 minutes and admixed with 50 g of ion-exchanged water containing 3 g of ammonium persulfate and thereafter the flask interior was purged with a nitrogen gas. The contents were continuously agitated gently and were heated to 70° C. by means of an oil bath, and the emulsion polymerization was continued in this state for 5 hours. In this way, there was prepared a resin dispersion liquid (2) which had an average particle diameter of 105 nm and which comprised particles of a resin having a glass transition point (Tg) of 53° C. and a weight average molecular weight (Mw) of 550,000.

(Preparation of colorant dispersion liquid (1))

| | |
|---|---|
| carbon black (Morgal L manufactured by Cabot Corporation) | 50 g |
| nonionic surfactant (Nonipole 400 manufactured by Sanyo Chemical Industries, Ltd.) | 5 g |
| ion-exchanged water | 200 g |

A mixture of the above ingredients was dispersed by means of a homogenizer (Ultratalax T50 manufactured by IKA Co., Ltd.) for 10 minutes and a dispersion liquid of colorant (1) which comprised a dispersed colorant (carbon black) having an average particle size of 250 nm was prepared.

(Preparation of release agent dispersion liquid (1))

| | |
|---|---|
| paraffin wax (HNP0190, having a melting point of 85° C., manufactured by Nippon Seiro Co., Ltd.) | 50 g |
| cationic surfactant (Sanizole B50 manufactured by Kao Corporation) | 5 g |
| ion-exchanged water | 200 g |

A mixture of the above ingredients was heated to 95° C. The mixture was then dispersed by means of a homogenizer (Ultratalax T50 manufactured by IKA Co., Ltd.) and was further dispersed by means of a pressure-ejection type homogenizer (Ultratalax T50 manufactured by IKA Co., Ltd.). In this way, a release agent dispersion liquid (1) which comprised a dispersed release agent having an average particle diameter of 550 nm was prepared.

(Preparation of toner particles A (black))

The resin dispersion liquid (1), the resin dispersion liquid (2), the colorant dispersion liquid (1), the release agent dispersion liquid (1) , each obtained as described above, and a cationic surfactant were mixed as follows:

| | |
|---|---|
| resin dispersion liquid (1) | 120.0 g |
| resin dispersion liquid (2) | 80.0 g |
| colorant dispersion liquid (1) | 200.0 g |
| release agent dispersion liquid (1) | 40.0 g |
| cationic surfactant (Sanizole B50 manufactured by Kao Corporation) | 1.5 g |

A mixture of the above ingredients was placed in a round-bottom stainless steel flask and was dispersed by means of a homogenizer (UltratalaxT50 manufacturedby IKA Co., Ltd.). The contents were heated to 50° C. by means of an oil bath while the contents were stirred and were then kept at 45° C. for 40 minutes. The results of the observation by means of an optical microscope confirmed the formation of flocculated particles having an average particle diameter of about 5.1 $\mu$m.

After that, 60 g of the resin dispersion (1) as a dispersion liquid of fine particles containing a resin was added gently to the above prepared dispersion. The volume of the resin particles contained in the resin dispersion (1) was 25 $cm^3$. The contents were then heated to 50° C. by means of an oil bath and the contents were kept at that temperature for 30 minutes. The results of the observation by means of an optical microscope confirmed the formation of adhered particles comprising the above-described flocculated particles and fine particles adhering thereto. The average particle diameter of the adhered particles thus formed was about 5.9 $\mu$m.

Next, to the dispersion obtained in the stainless steel flask was added 3 g of an anionic surfactant (Neogen SC manufactured by Daiichi Kogyo Seiyaku Co., Ltd.). Then, the stainless steel flask was hermetically sealed and the contents were heated to 105° C., while being stirred by means of a magnetic seal, and were held at that temperature for 3 hours. The contents were then cooled down, filtered, washed sufficiently with ion-exchanged water and dried. In this way, toner particles A (black) having $d_{50}$ of 6.0 $\mu$m and $ML^2/A$ of 119.8 were obtained.

(Preparation of toner particles A (cyan))

The procedure for the preparation of toner particles A (black) was repeated, except that 3% by weight of carbon black (Morgal L manufactured by Cabot Corporation) as used therein was replaced with 5% by weight of C. I. Pigment Blue 15:3. In this way, toner particles A (cyan) were obtained.

(Preparation of toner particles A (magenta))

The procedure for the preparation of toner particles A (black) was repeated, except that 3% by weight of carbon black (Morgal L manufactured by Cabot Corporation) as used therein was replaced with 6% by weight of C. I. Pigment Red 112. In this way, toner particles A (magenta) were obtained.

(Preparation of toner particles A (yellow))

The procedure for the preparation of toner particles A (black) was repeated, except that 3% by weight of carbon black (Morgal L manufactured by Cabot Corporation) as used therein was replaced with 7% by weight of C. I. Pigment Yellow 74. In this way, toner particles A (yellow) were obtained.

[Preparation of toner particles B]

| | |
|---|---|
| Linear styrene/acrylic resin<br>(a linear styrene/acrylic resin obtained from styrene/n-butyl acrylate; Tg = 58° C.; Mn = 4,000; Mw = 24,000) | 100% by weight |
| carbon black<br>(Morgal L manufactured by Cabot Corporation) | 3% by weight |

A mixture of the above-identified binding resin and colorant was blended in an extruder, and thereafter was pulverized by means of a jet mill. The resulting powder was treated by a classifier utilizing a wind force to obtain particles B (black) having $d_{50}$ of 6.2 $\mu$m and $ML^2/A$ of 140.2 Further, by using the same pigment compositions as in the case of the toner particles A, toner particles in different colors, i.e., toner particles B (cyan), toner particles B (magenta), and toner particles B (yellow), were obtained.

[Preparation of toner particles C]

The procedure for the preparation of toner particles A was repeated, except that the formation of the adhered particles was followed by the addition of an anionic surfactant and heating with stirring, and further by the addition of 1.5 g of an external additive A and stirring for 10 minutes using a magnetic seal. As a result, toner particles C (black) having $d_{50}$ of 6.0 $\mu$m and $ML^2/A$ of 118.7 were obtained. Further, by using the same pigment compositions as in the case of the toner particles A, toner particles in different colors, i.e., toner particles C (cyan), toner particles C (magenta), and toner particles C (yellow), were obtained.

By using the above-described external additives and the toner particles, electrostatic latent image developers 1~16 were prepared according to the procedures described in the following examples 1~13 and comparative examples 1~3.

Example 1

Toner is prepared by a process comprising the steps of blending 100 parts of the toner particles A and 1.0 part of the external additive A as a first external additive at a wind speed of 10 m/s for 1 minute and then at a wind speed of 30 m/s for 25 minutes by means of a Henschel mixer, adding 1.0 part of hexamethyldisilazane-treated silica having a BET specific surface area of 50 $m^2/g$ as a second external additive to the mixture, and blending the resulting mixture at a wind speed of 10 m/s for 1 minute and then at a wind speed of 30 m/s for 5 minutes by means of the Henschel mixer.

Then, electrostatic latent image developer 1 is prepared by a procedure comprising weighing into a vessel the toner obtained above and a ferrite carrier which has an average particle diameter of 50 $\mu$m and is coated with 1% of polymethyl methacrylate (manufactured by Soken Chemical Co., Ltd.) such that a toner concentration of 5% by weight is obtained, and thereafter blending the mixture by means of a V-shaped blender.

Example 2

Electrostatic latent image developer 2 is prepared by repeating the procedure of Example 1, except that the first external additive is replaced with a silicone oil-treated silica having a BET specific surface area of 100 $m^2/g$ and the second external additive is replaced with the external additive B.

Example 3

Electrostatic latent image developer 3 is prepared by repeating the procedure of Example 1, except that the amount of the external additive A as the first external additive is 2.5 parts.

Example 4

Electrostatic latent image developer 4 is prepared by repeating the procedure of Example 3, except that the first external additive is the external additive B.

Example 5

Electrostatic latent image developer 5 is prepared by repeating the procedure of Example 1, except that the second external additive is a silicone oil-treated silica having a BET specific surface area of 100 $m^2/g$.

Example 6

Electrostatic latent image developer 6 is prepared by repeating the procedure of Example 1, except that the second external additive is replaced with the external additive B.

Example 7

Electrostatic latent image developer 7 is prepared by repeating the procedure of Example 1, except that the toner particles A are replaced with the toner particles C.

Example 8

Electrostatic latent image developer 8 is prepared by repeating the procedure of Example 3, except that the amount of the first external additive is divided into 5 portions of 0.5 parts each and these portions are added stepwise in such a manner that, for each addition, the blending is carried out at a wind speed of 10 m/s for 1 minute and then at a wind speed of 30 m/s for 5 minutes by means of the Henschel mixer.

Example 9

Electrostatic latent image developer 9 is prepared by repeating the procedure of Example 1, except that 1.0 part of the external additive A as the first external additive and 1.0 part of hexamethyldisilazane-treated silica having a BET specific surface area of 50 $m^2/g$ as the second external additive are blended in advance at a wind speed of 10 m/s for 1 minute and thereafter 100 parts of toner particles A is added to the mixture and the resulting mixture is blended at a wind speed of 10 m/s for 1 minute and then at a wind speed of 30 m/s for 15 minutes by means of the Henschel mixer.

Example 10

Electrostatic latent image developer 10 is prepared by repeating the procedure of Example 8, except that the amount of the second external additive is divided into 2 portions of 0.5 parts each and these portions are added stepwise in such a manner that, for each addition, the blending is carried out at a wind speed of 10 m/s for 1 minute and then at a wind speed of 30 m/s for 5 minutes by means of the Henschel mixer.

Example 11

Electrostatic latent image developer 11 is prepared by repeating the procedure of Example 1, except that 1.0 part of the external additive A as the first external additive, 1.0 part of hexamethyldisilazane-treated silica having a BET specific surface area of 50 $m^2/g$ as the second external additive, and 0.5 parts of polyvinylidene fluoride particles having an average particle diameter of 300 nm are blended in advance at a wind speed of 10 m/s for 1 minute and thereafter 100 parts of toner particles A is added to the mixture and the resulting mixture is blended at a wind speed of 10 m/s for 1 minute and then at a wind speed of 30 m/s for 15 minutes by means of the Henschel mixer.

Example 12

Electrostatic latent image developer 12 is prepared by repeating the procedure of Example 11, except that the second external additive is replaced with a silicone oil-treated silica having a BET specific surface area of 100 $m^2/g$ and the third external additive is replaced with 0.5 parts of hexamethyldisilazane-treated silica having a BET specific surface area of 50 $m^2/g$.

Example 13

Toner is prepared by a process comprising the steps of adding 2.5 parts of the external additive A in 5 portions of 0.5 parts each stepwise to 100 parts of the toner particles A in such a manner that, for each addition, the blending is carried out at a wind speed of 10 m/s for 1 minute and then at a wind speed of 30 m/s for 5 minutes by means of a Henschel mixer.

Then, electrostatic latent image developer 13 is prepared by a procedure comprising weighing into a vessel the toner obtained above and a ferrite carrier which has an average particle diameter of 50 $\mu$m and is coated with 1% of polymethyl methacrylate (manufactured by Soken Chemical Co., Ltd.) such that a toner concentration of 5% by weight is obtained, and thereafter blending the mixture by means of a V-shaped blender.

Comparative Example 1

Electrostatic latent image developer 14 is prepared by repeating the procedure of Example 1, except that the toner particles A are replaced with the toner particles B and the blending of the toner particles with the two external additives is carried out simply at a wind speed of 30 m/s for 5 minutes by means of the Henschel mixer.

Comparative Example 2

Electrostatic latent image developer 15 is prepared by repeating the procedure of Example 1, except that the blending of the toner particles with the first external additive and the second external additive is carried out simply at a wind speed of 30 m/s for 5 minutes by means of the Henschel mixer.

Comparative Example 3

Electrostatic latent image developer 16 is prepared by repeating the procedure of Example 4, except that the blending of the toner particles with the first external additive and the second external additive is carried out simply at a wind speed of 30 m/s for 5 minutes by means of the Henschel mixer.

Measurements of physical characteristics and performance evaluations of the above-described electrostatic latent image developers 1~16 are made according to the following methods. The results of measurements and evaluations are shown in Tables 1~4.

[Measurements of physical characteristics]

(Particle diameter)

The particle diameters of the toner are measured by use of a particle size measuring apparatus "Coulter Counter TA11" manufactured by Coulter Electronics Corp. at an aperture diameter of 100 $\mu$m.

(Distribution of charge)

Distribution of charge is measured by means of a charge spectrograph which is a charge amount measuring apparatus described by R. B. Lewis et al. in "Journal of Electrophotographic Society", Vol. 22 (1983), No. 1. Under conditions of an electric field of 100 V/cm and an air flow rate of 100 cm/s, 30 g of carrier (a ferrite carrier which has an average particle diameter of 50 Mm and is coated with 1% of polymethyl methacrylate ) and 1.5 g of toner are blended for 60 second by means of a tumbler mixer. Then, distribution of charge is measured by means of the above-mentioned charge spectrograph. The environmental conditions for the measurement is 22° C. and 55% RH.

By defining the maximum charge amount as $C_{max}$, the minimum charge amount as $C_{min}$, and the most frequently observed charge amount as $C_{peak}$, the value obtained by $(C_{max}-C_{min})/C_{peak})$ is used as an index of the charge distribution. As this value approaches 0, the width of the charge distribution becomes narrower.

(Shape index)

The shape index $ML^2/A$ is calculated as explained previously.

(Correlation coefficient)

According to the method previously described, the present inventors measure the light emitting voltage X due to the carbon derived from the binding resin of the toner particles and the light emitting voltage Y due to the element derived from the external additive for about 1,000 units of the toner particles. Based on these data, they calculate correlation coefficients (r) derived from elements of external additives by using the equations (1)–(6). $r_1$ and $Y_1$ relate to the first external additive; $r_2$ and $Y_2$ relate to the second external additive; and $r_3$ and $Y_3$ relate to the third external additive; provided, however, that, if the first external additive and the second external additive are derived from the same element, r and Y are shown as derived from the first external additive.

TABLE 1

Evaluation of physical characteristics of latent image developers

| | Color | Diameter of particle | $ML^2/A$ | $r_1$ | $r_2$ | $r_3$ | Percentage (%) of $Y_1$ on $X^{2/3} = 0$ | Percentage (%) of $Y_2$ on $X^{2/3} = 0$ | Percentage (%) of $Y_3$ on $X^{2/3} = 0$ | Index of distribution of charge |
|---|---|---|---|---|---|---|---|---|---|---|
| Example 1 | Y | 6.0 | 120.0 | 0.70 | 0.75 | — | 1.1 | 2.0 | — | 1.34 |
| | M | 6.1 | 118.5 | 0.64 | 0.80 | — | 1.1 | 2.3 | — | 1.28 |
| | C | 6.2 | 119.5 | 0.62 | 0.80 | — | 1.2 | 2.5 | — | 1.30 |
| | K | 6.0 | 119.8 | 0.71 | 0.72 | — | 1.6 | 2.7 | — | 1.15 |
| Example 2 | Y | 6.0 | 120.0 | 0.82 | 0.65 | — | 4.7 | 0.3 | — | 1.53 |
| | M | 6.1 | 118.5 | 0.84 | 0.61 | — | 4.0 | 0.5 | — | 1.67 |
| | C | 6.2 | 119.5 | 0.83 | 0.61 | — | 4.2 | 0.2 | — | 1.57 |
| | K | 6.0 | 119.8 | 0.85 | 0.66 | — | 4.2 | 0.2 | — | 1.35 |
| Example 3 | Y | 6.0 | 120.0 | 0.65 | 0.82 | — | 1.1 | 1.7 | — | 1.12 |
| | M | 6.1 | 118.5 | 0.61 | 0.80 | — | 1.5 | 1.5 | — | 1.05 |
| | C | 6.2 | 119.5 | 0.66 | 0.83 | — | 1.3 | 1.3 | — | 1.23 |
| | K | 6.0 | 119.8 | 0.61 | 0.84 | — | 1.6 | 1.8 | — | 0.87 |

TABLE 2

(Continued from Table 1)

| | | | | | | | | | | |
|---|---|---|---|---|---|---|---|---|---|---|
| Example 4 | Y | 6.0 | 120.0 | 0.61 | 0.63 | — | 4.5 | 3.3 | — | 1.50 |
| | M | 6.1 | 118.5 | 0.64 | 0.64 | — | 4.3 | 3.2 | — | 1.52 |
| | C | 6.2 | 119.5 | 0.62 | 0.66 | — | 4.2 | 3.8 | — | 1.54 |
| | K | 6.0 | 119.8 | 0.62 | 0.67 | — | 4.5 | 3.4 | — | 1.29 |
| Example 5 | Y | 6.0 | 120.0 | 0.60 | 0.88 | — | 1.2 | 2.3 | — | 1.34 |
| | M | 6.1 | 118.5 | 0.67 | 0.84 | — | 1.1 | 2.2 | — | 1.28 |
| | C | 6.2 | 119.5 | 0.64 | 0.83 | — | 1.3 | 2.8 | — | 1.27 |
| | K | 6.0 | 119.8 | 0.62 | 0.86 | — | 1.0 | 2.5 | — | 1.04 |
| Example 6 | Y | 6.0 | 120.0 | 0.60 | — | — | 1.7 | — | — | 1.43 |
| | M | 6.1 | 118.5 | 0.64 | — | — | 1.6 | — | — | 1.37 |
| | C | 6.2 | 119.5 | 0.66 | — | — | 1.4 | — | — | 1.40 |
| | K | 6.0 | 119.8 | 0.65 | — | — | 1.6 | — | — | 1.27 |
| Example 7 | Y | 6.2 | 117.8 | 0.70 | 0.80 | — | 0.3 | 2.2 | — | 1.10 |
| | M | 6.1 | 119.5 | 0.69 | 0.84 | — | 0.2 | 2.5 | — | 1.15 |
| | C | 6.0 | 117.5 | 0.73 | 0.89 | — | 0.1 | 2.6 | — | 1.05 |
| | K | 6.0 | 118.7 | 0.71 | 0.88 | — | 0.1 | 2.7 | — | 0.95 |

TABLE 3

(Continued from Table 1)

| | | | | | | | | | | |
|---|---|---|---|---|---|---|---|---|---|---|
| Example 8 | Y | 6.0 | 120.0 | 0.67 | 0.83 | — | 1.3 | 1.5 | — | 0.85 |
| | M | 6.1 | 118.5 | 0.63 | 0.80 | — | 1.5 | 1.4 | — | 0.78 |
| | C | 6.2 | 119.5 | 0.65 | 0.81 | — | 1.5 | 1.1 | — | 0.83 |
| | K | 6.0 | 119.8 | 0.69 | 0.86 | — | 1.34 | 1.3 | — | 0.65 |
| Example 9 | Y | 6.0 | 120.0 | 0.70 | 0.81 | — | 1.0 | 2.3 | — | 1.15 |
| | M | 6.1 | 118.5 | 0.68 | 0.83 | — | 1.0 | 2.1 | — | 1.13 |
| | C | 6.2 | 119.5 | 0.71 | 0.81 | — | 1.2 | 2.2 | — | 1.08 |
| | K | 6.0 | 119.8 | 0.73 | 0.84 | — | 1.0 | 2.0 | — | 0.85 |
| Example 10 | Y | 6.0 | 120.0 | 0.78 | 0.75 | — | 0.9 | 1.1 | — | 1.06 |
| | M | 6.1 | 118.5 | 0.73 | 0.86 | — | 0.8 | 1.3 | — | 1.03 |
| | C | 6.2 | 119.5 | 0.75 | 0.87 | — | 0.8 | 1.1 | — | 0.98 |
| | K | 6.0 | 119.8 | 0.74 | 0.87 | — | 0.9 | 1.2 | — | 0.59 |
| Example 11 | Y | 6.0 | 120.0 | 0.73 | 0.85 | 0.64 | 0.3 | 2.0 | 1.5 | 1.23 |
| | M | 6.1 | 118.5 | 0.69 | 0.84 | 0.62 | 0.2 | 1.4 | 1.2 | 1.25 |
| | C | 6.2 | 119.5 | 0.70 | 0.86 | 0.66 | 0.1 | 1.7 | 1.0 | 1.34 |
| | K | 6.0 | 119.8 | 0.72 | 0.85 | 0.65 | 0.3 | 2.3 | 1.3 | 1.05 |

TABLE 4

(Continued from Table 1)

| | | | | | | | | | | |
|---|---|---|---|---|---|---|---|---|---|---|
| Example 12 | Y | 6.0 | 120.0 | 0.65 | 0.83 | 0.80 | 0.6 | 4.3 | 2.2 | 1.26 |
| | M | 6.1 | 118.5 | 0.67 | 0.81 | 0.88 | 0.4 | 4.2 | 2.1 | 1.31 |
| | C | 6.2 | 119.5 | 0.70 | 0.86 | 0.84 | 0.4 | 4.4 | 2.0 | 1.05 |
| | K | 6.0 | 119.8 | 0.69 | 0.85 | 0.83 | 0.5 | 4.5 | 2.2 | 0.96 |
| Example 13 | Y | 6.0 | 120.0 | 0.73 | — | — | 1.5 | — | — | 1.03 |
| | M | 6.1 | 118.5 | 0.74 | — | — | 1.4 | — | — | 1.05 |
| | C | 6.2 | 119.5 | 0.74 | — | — | 1.4 | — | — | 1.00 |
| | K | 6.0 | 119.8 | 0.75 | — | — | 1.6 | — | — | 0.84 |
| Comparative | Y | 6.2 | 142.3 | 0.54 | 0.56 | — | 1.1 | 3.4 | — | 2.53 |
| Example 1 | M | 6.0 | 141.5 | 0.54 | 0.54 | — | 1.2 | 3.5 | — | 2.64 |
| | C | 6.1 | 139.9 | 0.51 | 0.57 | — | 1.2 | 3.3 | — | 2.30 |
| | K | 6.2 | 140.2 | 0.47 | 0.57 | — | 1.6 | 3.8 | — | 1.86 |
| Comparative | Y | 6.0 | 120.0 | 0.45 | 0.56 | — | 5.3 | 9.0 | — | 6.53 |
| Example 2 | M | 6.1 | 118.5 | 0.42 | 0.51 | — | 5.6 | 9.3 | — | 6.34 |
| | C | 6.2 | 119.5 | 0.38 | 0.54 | — | 5.4 | 9.1 | — | 5.24 |
| | K | 6.0 | 119.8 | 0.40 | 0.55 | — | 5.5 | 9.2 | — | 3.89 |
| Comparative | Y | 6.0 | 120.0 | 0.34 | 0.49 | — | 7.0 | 9.9 | — | 8.36 |
| Example 3 | M | 6.1 | 118.5 | 0.36 | 0.45 | — | 7.2 | 9.5 | — | 8.28 |
| | C | 6.2 | 119.5 | 0.34 | 0.48 | — | 7.2 | 10.5 | — | 7.65 |
| | K | 6.0 | 119.8 | 0.37 | 0.50 | — | 7.2 | 10.3 | — | 3.65 |

From Tables 1~4, it can be seen that, in each of the latent image developers 1~13 according to the present invention, the correlation coefficient derived from the element of the external additive is more than 0.6 and the percentage of Y derived from each external additive on $X^{2/3}=0$ is 5% or less, thereby indicating that the amount of isolated external additive is slight. At the same time, since the index of the distribution of charge is 2 or less, it is apparent that the difference in charge between toner particles is insignificant.

By contrast, (Comparative Example 1) latent image developer 14, prepared by using amorphous toner particles obtained by blending/pulverizing, (Comparative Example 2) latent image developer 15, prepared by a single step of vigorously stirring the toner particles and the external additive, and (Comparative Example 3) latent image developer 16, prepared by a single step of vigorously stirring the toner particles and the external additive, each provide the correlation coefficient derived from the element of external additive of 0.6 or less, thereby indicating that the amount of isolated external additive is significant. At the same time, since the index of the distribution of charge is 3 or less, it is apparent that the difference in charge between toner particles is significant and that many toner particles each having reverse polarity are also present.

[Evaluation by means of an actual machine]

(Evaluation 1 by means of an actual machine)

Using developers 1~16 obtained in Examples and Comparative Examples, a copying test is conducted by means of a copying machine (a modified version of "A-color" manufactured by Fuji Xerox Co., Ltd.), and evaluation is made in terms of the following items. The modified version is prepared by converting the transfer section of "A-color" into a belt-transfer structure wherein a cleaning system designed for the cleaning of the transfer belt with a urethane blade is incorporated so that the multicolor image transferred to the transfer belt is transferred to image-receiving paper at one time and wherein the process speed is raised to make it possible to take 50 copies of A-4 size in one minute. The copying test is conducted by a full-color mode including black for taking 30,000 copies.

At the stage immediately after the start of the copying test and at the stage after taking 30,000 copies, the charge amount of the developer inside the developing device, the transfer efficiency, and SAD of the image obtained are measured and the image quality is evaluated. The term "SAD" is the abbreviation of Solid Area Density and indicates the image density.

The amounts of the electrostatic charge of the developer inside the developing device are measured by means of a blow off electrostatic charge meter manufactured by Toshiba Chemical Corporation. The SAD of the image is measured by means of an "X-rite 404A" manufactured by X-rite Corp. The image quality is visually evaluated with regard to the defects such as nonuniformity in image density, fogging on photoreceptors, fogging in non-image areas, and holes in the image.

The transfer efficiency is obtained by a procedure comprising the steps of measuring the weight of toner on the photoreceptor before and after the transfer for an image of 100 $cm^2$, and then calculating the transfer image by [1-{(the weight of toner on the photoreceptor after the transfer)/(the weight of toner on the photoreceptor before the transfer)}]=100.

The results are shown in Tables 5 and 6.

TABLE 5

Evaluation results by means of an actual machine (transfer by use of a belt)

| | Immediately after start | | | | After taking 30,000 copies | | | |
|---|---|---|---|---|---|---|---|---|
| | Amount of charge ($\mu$ Q/g) | SAD (3 colors) | Image quality | Transfer efficiency (%) | Amount of charge ($\mu$ Q/g) | SAD (3 colors) | Image quality | Transfer efficiency (%) |
| Example 1 | −33.2 | 1.56 | No problem | 98.3 | −28.3 | 1.50 | No problem | 97.0 |
| Example 2 | −36.2 | 1.56 | No problem | 96.2 | −32.3 | 1.48 | No problem | 95.1 |
| Example 3 | −30.9 | 1.52 | No problem | 99.2 | −26.3 | 1.50 | No problem | 95.4 |

TABLE 5-continued

| | Evaluation results by means of an actual machine (transfer by use of a belt) | | | | | | | |
|---|---|---|---|---|---|---|---|---|
| | Immediately after start | | | | After taking 30,000 copies | | | |
| | Amount of charge ($\mu$ Q/g) | SAD (3 colors) | Image quality | Transfer efficiency (%) | Amount of charge ($\mu$ Q/g) | SAD (3 colors) | Image quality | Transfer efficiency (%) |
| Example 4 | −36.8 | 1.49 | No problem | 96.1 | −27.4 | 1.48 | No problem | 92.8 |
| Example 5 | −39.1 | 1.45 | No problem | 95.9 | −33.6 | 1.40 | No problem | 91.3 |
| Example 6 | −33.2 | 1.56 | No problem | 96.4 | −30.0 | 1.47 | No problem | 95.4 |
| Example 7 | −29.6 | 1.49 | No problem | 99.2 | −26.7 | 1.46 | No problem | 97.8 |
| Example 8 | −30.1 | 1.50 | No problem | 98.0 | −26.9 | 1.48 | No problem | 97.5 |
| Example 9 | −35.6 | 1.51 | No problem | 98.8 | −29.6 | 1.44 | No problem | 96.0 |
| Example 10 | −30.5 | 1.52 | No problem | 98.4 | −27.3 | 1.47 | No problem | 97.4 |
| Example 11 | −37.5 | 1.50 | No problem | 99.0 | −35.6 | 1.44 | No problem | 98.3 |
| Example 12 | −37.4 | 1.56 | No problem | 97.9 | −34.6 | 1.43 | No problem | 94.5 |
| Example 13 | −25.6 | 1.53 | No problem | 98.7 | −23.4 | 1.46 | No problem | 97.9 |

TABLE 6

| (Continued from Table 5) | | | | | | | | |
|---|---|---|---|---|---|---|---|---|
| Comparative Example 1 | −24.8 | 1.52 | Occurrence of slight nonuniformity in density | 80.3 | −17.5 | 1.18 | Occurrence of fogging on photoreceptor and in non-image areas | 73.5 |
| Comparative Example 2 | −34.6 | 1.49 | Occurrence of fogging on photoreceptor and in non-image areas | 97.8 | −30.4 | 1.26 | Occurrence of fogging on photoreceptor and in non-image areas | 94.5 |
| Comparative Example 3 | −30.6 | 1.55 | Occurrence of fogging on photoreceptor and in non-image areas | 92.6 | −25.4 | 1.23 | Occurrence of fogging on photoreceptor and in non-image areas, and occurrence of holes in image | 90.0 |

From Tables 5 and 6, it can be seen that electrostatic latent image developers 1~13 according to the present invention exhibit good performances in terms of density, image quality, transfer efficiency, and fogging on the photoreceptor in the copying test conducted by means of a copying machine (a modified version of "A-color" manufactured by Fuji Xerox Co., Ltd.), thereby suggesting the absence of problems from the standpoint of maintenance. In particular, the developers of electrostatic images which use the external additive A exhibit good transfer efficiency.

By contrast, electrostatic latent image developer 14 according to Comparative Example 1 produces fogging on the photoreceptor immediately after the start of the copying test and exhibits very poor transfer efficiency. Particularly, the toner, once transferred to the transfer belt, returned to the photoreceptor. After taking 30,000 copies, the amount of toner in the form of fogging on the photoreceptor further increases and the toner is also present in the background area of the paper carrying the copy.

The transfer efficiency of electrostatic latent image developers 15 and 16 according to Comparative Examples 2 and 3, respectively, are not so poor as that of Comparative Example 1. However, electrostatic latent image developers 15 and 16 produce serious fogging on the photoreceptor and exhibited a high consumption of toner as in the case of electrostatic latent image developer 14 according to Comparative Example 1. The toner is also present in the background area of the paper carrying the copy. Particularly, in the case of electrostatic latent image developer 16 according to Comparative Example 3, scratches are formed on the photoreceptor presumably by isolated titanium oxide and, as a result, holes occur in the image.

(Evaluation 2 by means of an actual machine)

Using developers 1~16 obtained in Examples and Comparative Examples, a copying test is conducted by means of a copying machine (a modified version of "A-color" manufactured by Fuji Xerox Co., Ltd.), and evaluation is made in terms of the following items. The modified version employed in the evaluation 2 by means of an actual machine is prepared by excluding the cleaning system from the modified version "A-color" which is employed in the evaluation 1 by means of an actual machine. The copying test is conducted in a black and white mode for taking 30,000 copies.

As in the evaluation 1 by means of an actual machine, at the stage immediately after the start of the copying test and at the stage after taking 30,000 copies, the charge amount of the developer inside the developing device, the transfer efficiency, and SAD of the image obtained are measured and the image quality is evaluated. The results are shown in Tables 7 and 8.

TABLE 7

Evaluation results by means of an actual machine (without the cleaning step)

| | Immediately after start | | | | After taking 30,000 copies | | | |
|---|---|---|---|---|---|---|---|---|
| | Amount of charge ($\mu$ Q/g) | SAD (K) | Image quality | Transfer efficiency (%) | Amount of charge ($\mu$ Q/g) | SAD (K) | Image quality | Transfer efficiency (%) |
| Example 1 | −31.5 | 1.50 | No problem | 99.2 | −27.5 | 1.45 | No problem | 97.7 |
| Example 2 | −35.2 | 1.43 | No problem | 97.1 | −30.0 | 1.41 | No problem | 96.0 |
| Example 3 | −29.8 | 1.49 | No problem | 99.3 | −25.1 | 1.45 | No problem | 96.9 |
| Example 4 | 34.0 | 1.42 | No problem | 96.3 | −28.5 | 1.40 | No problem | 94.7 |
| Example 5 | −36.7 | 1.40 | No problem | 95.0 | −30.5 | 1.37 | No problem | 92.3 |
| Example 6 | −30.0 | 1.49 | No problem | 96.6 | −26.0 | 1.45 | No problem | 94.3 |
| Example 7 | −27.5 | 1.46 | No problem | 99.8 | −25.0 | 1.43 | No problem | 97.2 |
| Example 8 | −28.7 | 1.48 | No problem | 98.4 | −26.3 | 1.44 | No problem | 97.1 |
| Example 9 | −30.2 | 1.43 | No problem | 99.2 | −25.5 | 1.42 | No problem | 96.4 |
| Example 10 | −29.3 | 1.51 | No problem | 99.3 | −27.8 | 1.45 | No problem | 97.6 |
| Example 11 | −35.0 | 1.45 | No problem | 99.2 | −33.5 | 1.42 | No problem | 97.3 |
| Example 12 | −35.8 | 1.43 | No problem | 96.9 | −31.2 | 1.40 | No problem | 94.6 |
| Example 13 | −27.8 | 1.45 | No problem | 99.4 | −23.5 | 1.43 | No problem | 98.7 |

TABLE 8

(Continued from Table 7)

| | | | | | | | | |
|---|---|---|---|---|---|---|---|---|
| Comparative Example 1 | −27.5 | 1.56 | Occurrence of slight nonuniformity in density | 85.6 | −19.7 | 1.17 | Occurrence of nonuniformity in density, fogging on photoreceptor and in non-image areas, and occurrence of holes in image | 78.2 |
| Comparative Example 2 | −32.0 | 1.42 | Occurrence of fogging on photoreceptor and in non-image areas | 98.6 | −27.8 | 1.25 | Occurrence of fogging on photoreceptor and in non-image areas | 95.5 |
| Comparative Example 3 | −31.2 | 1.45 | Occurrence of fogging on photoreceptor and in non-image areas | 92.6 | −27.5 | 1.20 | Occurrence of fogging on photoreceptor and in non-image areas, and occurrence of holes in image | 90.2 |

From Tables 7 and 8, it can be seen that electrostatic latent image developers 1~13 according to the present invention exhibit good performances in terms of density, image quality, transfer efficiency, and fogging on the photoreceptor also in the copying test conducted by means of a copying machine (i.e., a modified version prepared by excluding the cleaning step from "A-color"), thereby suggesting absence of problems from the standpoint of maintenance. In particular, the electrostatic image developers which use the external additive A exhibit better transfer efficiency and better performance.

By contrast, at the stage immediately after the start of the copying test, electrostatic latent image developer 14 according to Comparative Example 1 exhibits very poor transfer efficiency, although this developer presents no problem in terms of fogging on the photoreceptor, image quality, and density. Another problem observed is nonuniformity in density presumably because the residual toner after transfer is not sufficiently recovered into the developing device. After taking 30,000 copies, problems include a decrease in density due to an insufficient amount of charge and fogging on the photoreceptor. According to the measurement of the diameter of the toner inside the developing device, the diameter of the toner particles is found to be 4.9$\mu$, thereby indicating a reduction in particle size. This results suggest that the toner, which is recovered in the developing device without being used in developing and transfer, impairs the chargeability.

At the stage immediately after the start of the copying test, electrostatic latent image developer 15 according to Comparative Example 2 exhibits good transfer efficiency, but this developer produces considerable fogging on the photoreceptor and serious fogging in non-image areas on paper. After taking 30,000 copies, the problems include contamination of the interior of the developing device with toner in addition to the problems at the stage immediately after the start of the copying test. Another problem observed is nonuniformity in density presumably because the residual toner after transfer is not sufficiently recovered into the developing device.

In the case of electrostatic latent image developer 16 according to Comparative Example 3, scratches are formed on the photoreceptor presumably by isolated titanium oxide and, as a result, holes occurrs in the image after taking 30,000 copies, in addition to the problems similar to those of electrostatic latent image developer 15 according to Comparative Example 2.

As stated above, the present invention provides toner for an electrostatic latent image developer, said toner being capable of meeting the requirements of fluidity, chargeability, developability, transferability, and freedom from fogging on a photoreceptor and from contamination of the interior of a developing device at the same time and for a long period of time, and also capable of eliminating the problems in a system, in which the residual toner is recovered concurrently with developing without adopting the cleaning step, while ensuring good images for a long period of time, and a method for producing the toner as well as an electrostatic latent image developer and an image forming method using the toner.

What is claimed is:

1. Toner for developing an electrostatic latent image comprising toner particles containing a colorant and a binder resin, and one or more external additives, wherein the toner particles having spherical shape with shape index ML 2/A of less than 125 and wherein the correlation coefficient between $X^{2/3}$ and Y by linear regression with respect to a straight line which passes through the origin of coordinate to axes is more than 0.6, where X is the light emitting voltage due to the carbon derived from the binding resin of the toner particles and Y is the light emitting voltage due to the element derived from the external additive.

2. Toner for an electrostatic latent image developer according to claim 1, wherein the toner contains two or more external additives as the external additive.

3. Toner for an electrostatic latent image developer according to claim 1, wherein the toner contains as the external additive at least one external additive whose BET specific surface area is in the range of from 20 to 250 $m^2/g$.

4. Toner for an electrostatic latent image developer according to claim 1, wherein the external additive is selected from the group consisting of silica, titanium compounds, alumina, cerium oxide, calcium carbonate, magnesium carbonate, calcium phosphate, fluorine-containing resin particles, silica-containing resin particles, and nitrogen-containing resin particles.

5. Toner for an electrostatic latent image developer according to claim 4, wherein the titanium compound is obtained by reacting a silane compound or a silicone oil with a part or the whole of $TiO(OH)_2$ produced by a wet process.

6. Toner for an electrostatic latent image developer according to claim 4, wherein the titanium compound is a titanium compound having a specific gravity in the range of from 2.8 to 3.6.

7. Toner for an electrostatic latent image developer according to claim 1, wherein the total of Y derived from the particles present on a straight line of $X^{2/3}=0$ is 5% or less of the total of Y derived from other particles, where X is the light emitting voltage due to the carbon derived from the binding resin of the toner particles and Y is the light emitting voltage due to the element derived from the external additive.

8. A method for producing toner for an electrostatic latent image developer according to claim 1, said method comprising mixing toner particles with an external additive, wherein the mixing is performed in a two-step operation, comprising a pre-mixing operation using a small amount of energy and a final mixing operation using a large amount of energy.

9. A method for producing toner for an electrostatic latent image developer according to claim 8, wherein the external additive is added stepwise to the toner particles.

10. A method for producing toner for an electrostatic latent image developer according to claim 8, wherein two or more external additives are added in the form of a blend thereof prepared in advance.

11. A method for forming an image comprising forming an electrostatic latent image on a latent image support, forming a toner layer on a surface of a developer support which faces the latent image support, developing the electrostatic latent image on the latent image support with said toner layer to form a toner image, and transferring the toner image developed onto a transfer material, wherein said toner comprises the toner of claim 1.

12. An image forming method according to claim 11, wherein a cleaning step is not included in the image forming method.

13. A method for forming an image according to claim 11, wherein the method further comprises forming a full color image by overlaying sequentially in any order toner images of at least three colors including cyan, magenta and yellow onto the transfer material.

14. A method for forming an image according to claim 13, wherein the method comprises multiple transferring step.

15. A method for forming an image according to claim 14, wherein the method comprises multiple transferring step contains using a transferring belt.

* * * * *